United States Patent [19]

Willis

[11] 4,403,666

[45] Sep. 13, 1983

[54] SELF CENTERING TONGS AND TRANSFER ARM FOR DRILLING APPARATUS

[75] Inventor: Clyde A. Willis, Wichita Falls, Tex.

[73] Assignee: Walker-Neer Manufacturing Co. Inc., Wichita Falls, Tex.

[21] Appl. No.: 269,279

[22] Filed: Jun. 1, 1981

[51] Int. Cl.[3] ..... F21B 19/00

[52] U.S. Cl. ..... 175/85; 175/52; 81/57.16

[58] Field of Search ..... 175/85, 52; 414/22; 173/164; 81/57.16, 57.20, 57.34; 308/3.9; 24/263 DA

[56] References Cited

U.S. PATENT DOCUMENTS

| | | | |
|---|---|---|---|
| Re. 26,284 | 10/1967 | O'Neill et al. | 175/57 |
| 3,336,991 | 8/1967 | Klem et al. | 175/85 |
| 3,799,009 | 3/1974 | Guier | 81/57.16 |
| 4,303,270 | 12/1981 | Adair | 294/88 |

*Primary Examiner*—Stephen J. Novosad
*Assistant Examiner*—Thuy M. Bui
*Attorney, Agent, or Firm*—Hume, Clement, Brinks, Willian & Olds, Ltd.

[57] ABSTRACT

A drill rig having a drill rig mast and a transfer arm is described. The clamps of the transfer arm are resiliently mounted to the transfer arm so as to provide limited axial movement of the clamps and thereby of a clamped down hole tubular. This resilient support for the down hole tubular serves to reduce damage to the threaded ends of the tubular during tubular handling operations. In addition, the clamps of the transfer arm are provided with resilient clamping surfaces which serve to engage the clamped tubular frictionally, without gouging or deeply scratching the surface thereof. A pair of automatic, self-centering, hydraulic tongs is provided for making up and breaking out threaded connections of tubulars having various diameters without manual adjustment of the tongs.

31 Claims, 9 Drawing Figures

SELF CENTERING TONGS AND TRANSFER ARM FOR DRILLING APPARATUS

BACKGROUND OF THE INVENTION

The present invention relates to improvements in transfer arms used to move lengths of down hole tubulars between a lowered position, near ground level, and a raised position in a drilling apparatus, and to improved, self centering, hydraulically actuated tongs for making up and breaking out threaded connections in a string of down hole tubulars such as drill pipe, for example.

Drilling rigs with transfer arms and hydraulically actuated tongs are known to the art. U.S. Pat. No. Re. 26,284, issued Oct. 17, 1967 on an application of J. V. O'Neill, et al., is one early example of such a drilling rig. Such drilling rigs provide important advantages in terms of improved safety of operation, increased speed of operation, and reduced numbers of required operating personnel, as compared with conventional drilling rigs of the prior art. However, such drilling rigs have in the past suffered from certain disadvantages.

For example, one type of prior art transfer arm utilizes clamps for down hole tubulars, which clamps are rigidly mounted to the transfer arm during use. When such transfer arms are used in connection with drilling rigs having top head drives, the threaded ends of a clamped tubular can be damaged easily, as can the clamps and the transfer arm itself, if the operator is not careful to control the axial forces applied to the clamped tubular with the top head drive during make up and break out operations. Furthermore, this type of prior art transfer arm provides no adequate indication of the axial forces that are being applied to the clamped tubular, thereby further increasing the prospect of damaged tubulars, transfer arms and clamps.

In addition, it is customary to use rigid, serrated carbide inserts in transfer arm clamps, and these inserts can deeply gouge and scratch clamped tubulars during handling operations. Such gouging can materially damage a clamped tubular, for transfer arm clamps customarily grip the relatively thin walled intermediate section of a clamped tubular, rather than the tool joints.

Another drawback of the prior art relates to hydraulic tongs. Commonly available tongs are not self centering. That is, they cannot be used to center tubulars of widely differing diameters about a common clamping axis without manual adjustment. Such manual adjustment of course requires time and slows the operation of the drilling rig.

SUMMARY OF THE INVENTION

The present invention is directed to improved mounts for transfer arm clamps, improved transfer arm clamps, and improved tongs which alleviate these and other disadvantages of the prior art.

According to a first feature of this invention, a transfer arm is provided with at least one clamp adapted to grip a down hole tubular having threaded ends. Means are provided for mounting the clamp to the transfer arm such that the clamp is movable along an axis which is substantially parallel to the longitudinal axis of a clamped down hole tubular. In addition, means are provided for resiliently biasing the clamp to a rest position with respect to the transfer arm such that the mounting means and the biasing means cooperate to permit movement of the clamp under axial loads applied under tubular handling operations, thereby reducing wear and damage to the threaded end of a clamped down hole tubular.

This first feature of the invention provides two important advantages over rigidly mounted transfer arm clamps of the prior art. First, since the clamps are resiliently positioned such that they can move axially under applied loads, the clamped tubular can move axially as necessary to reduce loads applied to the threaded ends of the tubular during make up and break out operations. In addition, the position of the clamped tubular with respect to the transfer arm provides an immediate, visual indication of the magnitude of the axial loads being applied to the clamped tubular. In this way, an operator is provided with the information needed to allow him to protect the clamped tubular from excessive axial loads. Both of these advantages cooperate to reduce the incidence of thread damage to a clamped tubular during handling operations.

According to a second feature of this invention, a transfer arm clamp is provided with at least one resilient clamping surface. Preferably, this clamping surface is formed of a plastic material such as high density polyurethane in which there may be embedded a granular abrasive material such as sand or carbide to avoid axial slipping of clamped tubulars.

The resilient clamping surfaces of this second feature of the invention serve to reduce the degree to which a clamped tubular is scratched or gouged by the transfer arm clamps, thereby reducing damage to and extending the operational life of clamped tubulars.

According to a third feature of this invention, a drilling apparatus is provided with a pair of hydraulically actuated, self centering tongs positioned to make up and break out threaded lengths of down hole tubulars from a string. Because these tongs are self-centering, they operate to center a tubular about a predetermined clamping axis for tubulars of widely varying diameters. These tongs can therefore be used for a wide range of tubulars without manual adjustment. In this way the need for manual adjustment is reduced or eliminated, and therefore the speed of operation of the tongs is increased.

The self centering tongs of this invention provide the important advantage that in assembling a string of tubulars such as drill pipe, the tongs can be used to center an upper length of drill pipe prior to mating the upper length to a lower length, included in the string. In this way, even crooked tubulars such as drill pipe may be assembled without ever requiring manual centering of the upper length. The tongs of this invention provide an important safety advantage, in that operators can, to a large extent, stay away from moving lengths of tubulars, and can instead achieve the necessary control over the tubular by remote manipulation of the tongs of this invention.

As used herein, the term "down hole tubular" denotes a length of a tube, rod or pipe of the type used in well drilling and finishing operations. This term is to be understood to include, without limitation, such items as drill pipe, drill collars, production tubing, sucker rods, and the like.

This invention, together with further objects and attendant advantages, will best be understood by reference to the following detailed description taken in conjunction with the accompanying drawings.

BRIEF DESCRIPTION OF THE DRAWINGS

FIG. 1 is a partial side elevational view showing a drilling rig which incorporates preferred embodiments of the three features of the present invention described above, in which the transfer arm is shown in a lowered, substantially horizontal position.

FIG. 5 is a sectional view taken along line 5—5 of FIG. 1.

FIG. 6 is a sectional view taken along line 6—6 of FIG. 1.

DETAILED DESCRIPTION OF THE PRESENTLY PREFERRED EMBODIMENTS

Figure 1A:
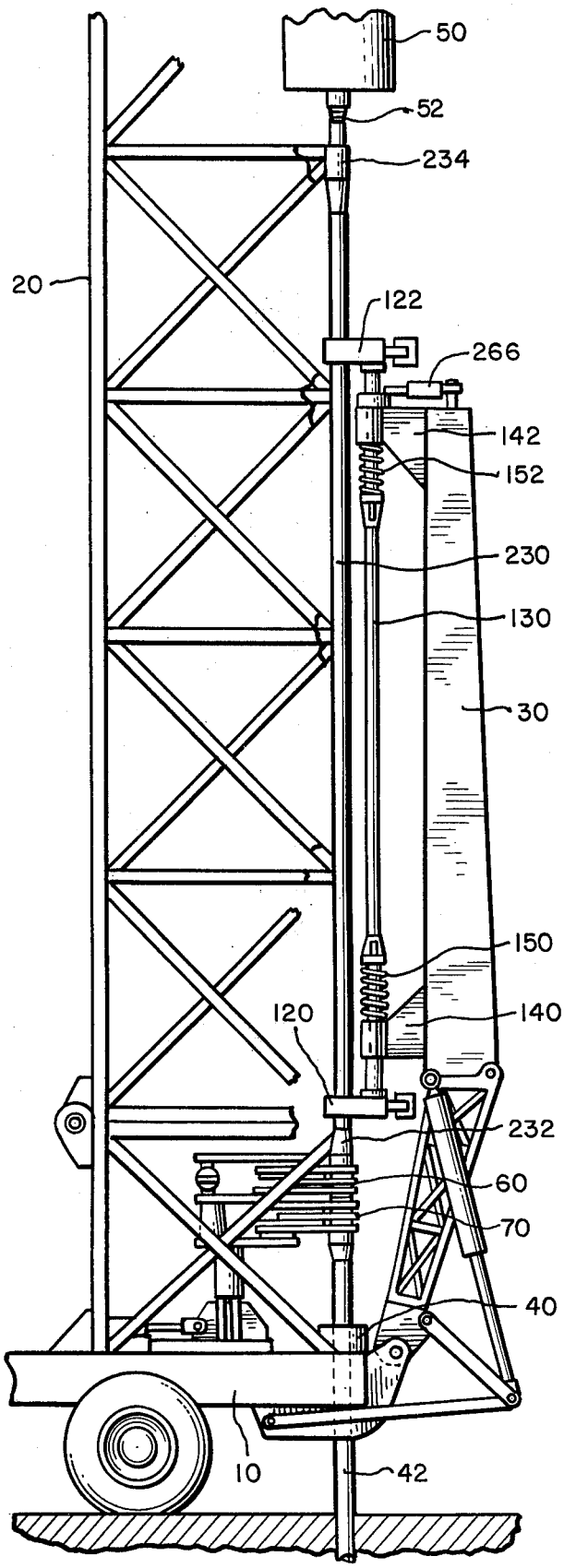
FIG. 1*a* is a partial side elevational view of the structure of FIG. 1 showing the transfer arm in a raised, substantially vertical position.

Referring now to the drawings, FIG. 1 shows a side elevational view of relevant portions of a mobile or portable drilling rig which embodies the three features of the present invention described briefly above. As shown in FIG. 1, the drilling rig is mounted on a wheeled carrier or semi-trailer 10, and a mast 20 is mounted near the end of the carrier or semi-tralier 10. Although shown here mounted on a wheeled carrier or semi-trailer, the drilling rig may be mounted on a portable substructure which may be either separate from or form a part of a carrier or semi-trailer. The mast 20 extends substantially vertically when it is set up for use, as shown in FIGS. 1 and 1*a*.

A transfer arm 30 is pivotably mounted to the rear of the carrier 10 at a pivot 34. A hydraulic cylinder 36 is provided to move the transfer arm 30 between a lowered, substantially horizontal position (as shown in FIG. 1) and a raised, substantially vertical position (as shown in FIG. 1*a*). Means, such as slips 40, for supporting a string of down hole tubulars are also mounted on the carrier 10. The slips 40 serve to transfer the weight of a string 42 of down hole tubulars onto hydraulic jacks (not shown) via the carrier 10 or, alternatively, onto a substructure (also not shown) during certain phases of the tubular handling operation.

As best shown in FIG. 1*a*, the illustrated drill rig also includes a power swivel 50 which is provided with a rotatable member 52. This power swivel 50 is arranged to move vertically within the mast 20, and it includes means for rotating the rotatable member 52. In this embodiment the power swivel 50 is used both to lift and to rotate individual lengths of down hole tubulars, as well as the string 42 of down hole tubulars.

The portions of the drilling rig described above are structures which form the working environment for the present invention. These structures are familiar to those skilled in the art and accordingly will not be described in detail here.

Figure 2A:
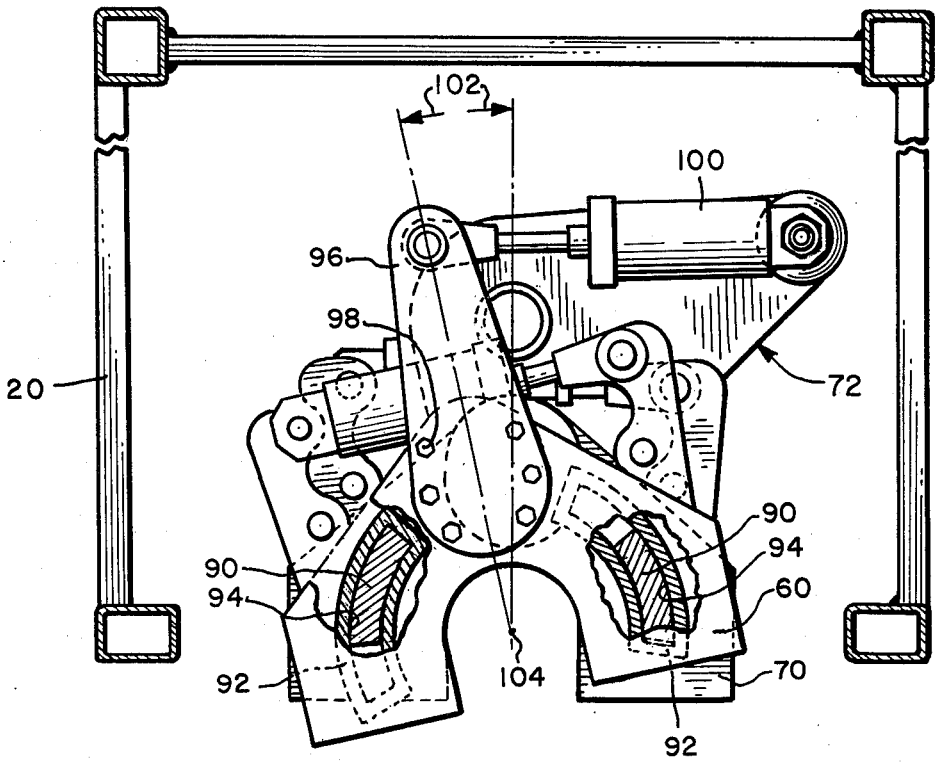
FIG. 2*a* is a sectional view taken along line 2*a*—2*a* of FIG. 1.
Figure 2B:
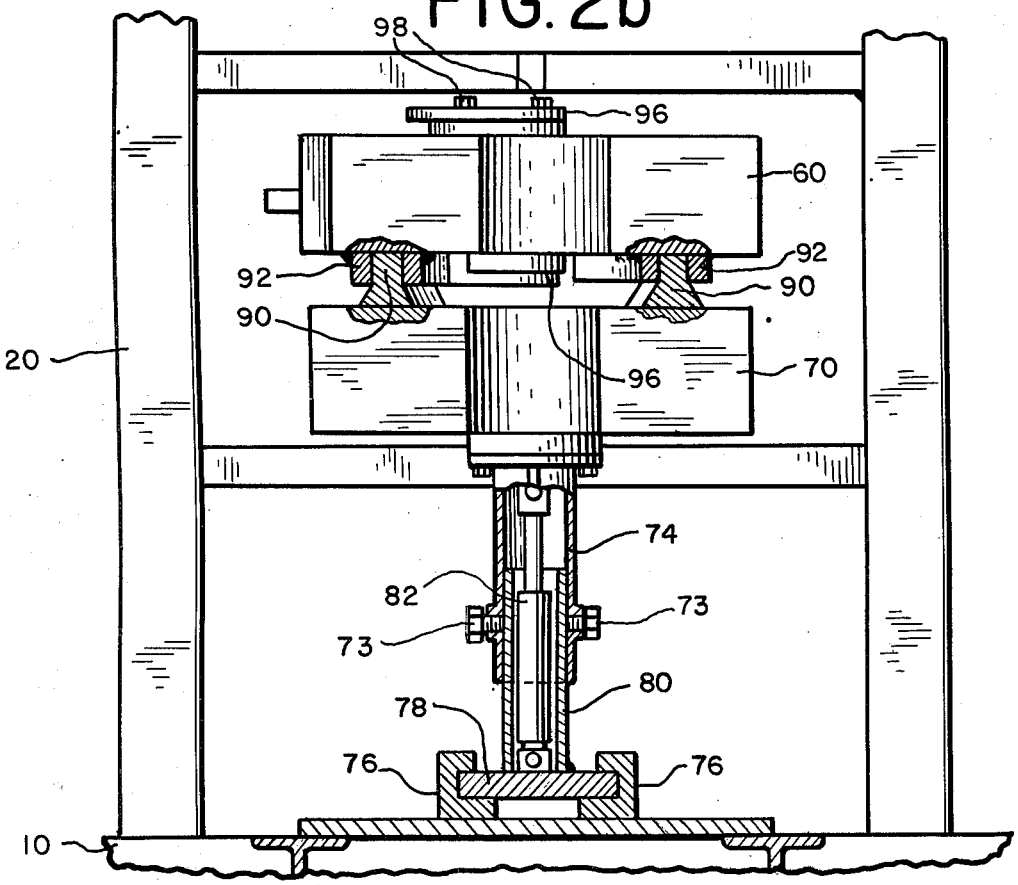
FIG. 2*b* is a sectional view taken along line 2*b*—2*b* of FIG. 1.
Figure 2C:
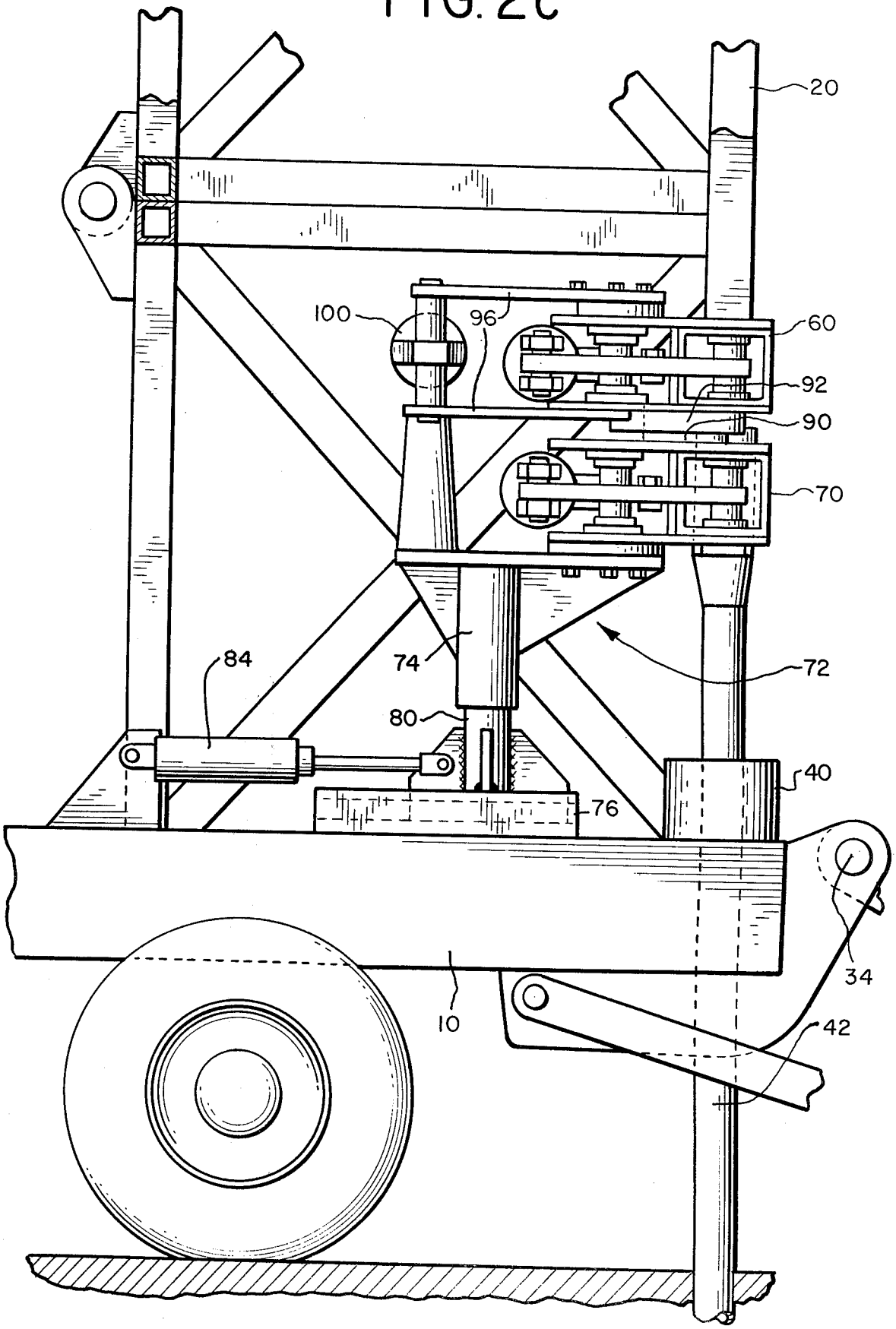
FIG. 2*c* is an enlarged side elevational view in partial cutaway of a portion of the drill rig of FIG. 1.

Turning now to FIGS. 2*a*, 2*b*, and 2*c*, the drilling rig of FIG. 1 includes a pair of remotely controlled, self-centering, hydraulic wrenches (or "tongs" as they are called herein) 60,70. As best shown in FIG. 2*c*, the lower hydraulic tong 70 is rigidly mounted to a base 72 which includes a vertically oriented tube 74. As shown in FIG. 2*b*, a pair of spaced, parallel guides 76 are rigidly mounted to the carrier 10. A support plate 78 is slidably installed within the guides 76 such that the support plate 78 is free to slide laterally along the length of the guides 76. A column 80 is rigidly mounted to the support plate 78 such that the column 80 fits within the tube 74.

A hydraulic cylinder 82 is positioned within the column 80 and is secured at one end to the support plate 78 and at the other end to the base 72. Thus, the base, and therefore the hydraulic tongs 60,70, are raised when the hydraulic cylinder 82 is extended. As will be explained in detail below, hydraulic cylinder 82 is used to control the height of the hydraulic tongs 60,70 during use. Locking screws 73 serve to lock the angular position of the tube 74 with respect to the column 80.

As best shown in FIG. 2*c*, a second hydraulic cylinder 84 is mounted between the carrier 10 and the lower end of the column 80. This second hydraulic cylinder 84 is oriented substantially parallel to the bed of the carrier 10, and it operates to move the support plate 78 within the guides 76, thereby laterally displacing the hydraulic tongs 60,70. The second hydraulic cylinder 84 is used to move the hydraulic tongs 60,70 between a first position (as shown in FIG. 2*c*) in which the tongs 60,70 are aligned over the axis of the string 42 of down hole tubulars, and a retracted, second position (shown in dotted lines in FIG. 1*a*) in which the tongs 60,70 are laterally displaced away from the axis of the string 42. In this way, the tongs 60,70 can readily be moved to a retracted position in which they do not impede or otherwise interfere with access to the string 42 of tubulars.

As best shown in FIGS. 2*a* and 2*b*, the upper hydraulic tong 60 is supported directly over the lower hydraulic tong 70 by means of two spaced arcuate guides 90. Each of these guides 90 is mounted to the upper surface of the lower hydraulic tong 70. The upper hydraulic tong 60 is provided with two guide tracks 92 on its lower surface. Each of these guide tracks 92 is provided with an arcuate cut-out 94 which allows the respective guides 90 to contact the lower surface of the upper hydraulic tong 60 directly. The guide tracks 92 serve a guiding function in that they limit the movement of the upper hydraulic tong 60 with respct to the lower hydraulic tong 70 to rotation about the clamping axis. In this preferred embodiment, the upper hydraulic tong 60 is not secured to the guides 90, and it is merely the weight of the upper hydraulic tong 60 which holds the upper tong 60 in place with the guides 90 situated within the cut-outs 94 of the respective guide tracks 92. Preferably, grease fittings (not shown) are provided to introduce lubricants such as grease between the guides 90 and the respective guide tracks 92.

Upper and lower lever arms 96 are rigidly mounted to the upper hydraulic tong 60 by means of fasteners such as bolts 98. A third hydraulic cylinder 100 is mounted between the ends of the lever arms 96 and the base 72. As best shown in FIG. 2*a*, this third hydraulic cylinder 100 acts to rotate the upper hydraulic tong 60 with respect to the lower hydraulic tong 70. The extent of rotation is indicated in FIG. 2*a* by the angle marked by the arrows 102. When the hydraulic cylinder 100 is extended the upper hydraulic tong 60 is rotated in a counterclockwise direction as seen from above; conversely when the hydraulic cylinder 100 is retracted the upper hydraulic tong 60 is rotated in a clockwise direction as seen from above.

Each of the hydraulic tongs 60,70 is a self-centering clamp adapted to grip the tool joint of a respective length of down hole tubular. Both tongs 60,70 can comprise similar clamps. In this preferred embodiment, these clamps are self-centering without manual adjustment. That is, each clamp operates to grip a length of down hole tubular about a fixed, predetermined clamping axis, regardless of the diameter of the clamped tubular. With the tongs 60,70 mounted as shown in FIG. 1, this clamping axis is oriented vertically and passes through the point 104 of FIG. 2*a*.

The detailed structure of the clamps used in the tongs 60,70 will be described below in connection with FIG. 6. Here it is enough to emphasize that because each of the tongs 60,70 operates to clamp a clamped tubular about a predetermined clamping axis, regardless of the diameter of the clamped tubular, no manual adjustment is needed to use the tongs 60,70 with various diameters of down hole tubulars. This is an important advantage, for it is routine to use a single set of hydraulic tongs 60,70 with down hole tubulars having a wide range of diameters during a single well drilling and finishing operation. Because the need for manual adjustment of the tongs 60,70 is eliminated, the embodiment shown in the drawings operates more simply and quickly than hydraulic tongs of the prior art which do not provide automatic self-centering as described above.

Turning now to the transfer arm shown in FIGS. 1 and 1*a*, a pair of clamps 120,122 are mounted to the transfer arm 30 by means of a support structure, which in this embodiment includes a shaft 130 which is slideably mounted to the transfer arm 30 by means of two spaced guide structures 140,142. These guide structures 140,142 serve to maintain the shaft 130 in precise alignment with respect to the transfer arm 30 while allowing the shaft 130 limited axial movement. The shaft 130 is provided with two spaced flanges 132,134, each of which is positioned near a respective one of the guide structures 140,142. Coil springs 150,152 are positioned concentrically about the shaft 130 so as to bear between the guide structures 140,142 and a respective one of the flanges 132,134. Each of the coil springs 150,152 resiliently resists the movement of the shaft 130 in a respective axial direction. Thus, the coil springs 150,152 act to bias the shaft 130 resiliently to a rest position. Preferably, the coil springs 150,152 are proportioned so as to allow the shaft 130 to move approximately six inches to either side of this rest position. Preferably, the spring constant of these coil springs 150,152 is in the range of 1,000 to 2,000 pounds per inch of axial travel.

Figure 3:
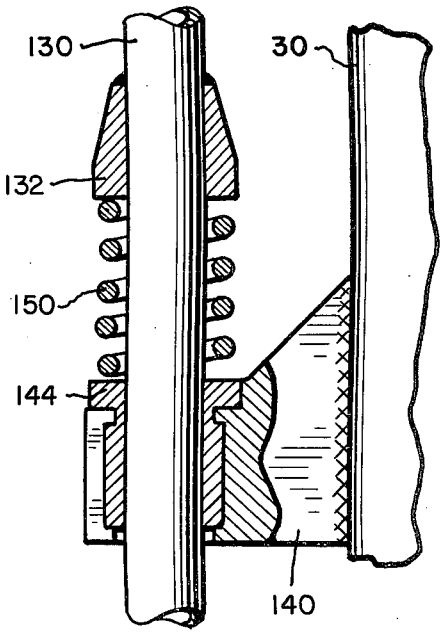
FIG. 3 is an enlarged view in partial cutaway of a portion of the transfer arm of FIG. 1.

FIG. 3 shows a detailed view in partial cutaway of a portion of the transfer arm 30 and the shaft 130, in which it can be clearly seen that the guide structure 140 includes a bushing 144 which acts to guide the axial movement of the shaft 130 with respect to the transfer arm 30. This bushing 144 also serves as a contact surface for the coil spring 150. Preferably, the flange 132 is welded to the shaft 130 as shown in FIG. 3.

Figure 4:
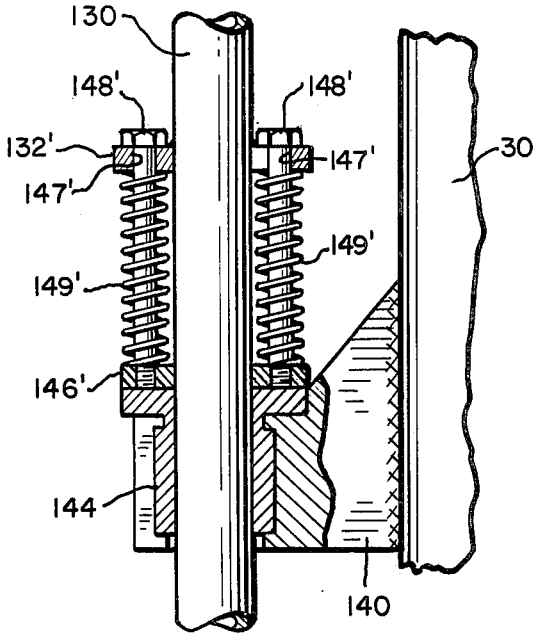
FIG. 4 is an enlarged view in partial cutaway of a second preferred embodiment which corresponds to the structure of FIG. 3.

FIG. 4 shows a portion of a second preferred embodiment of this invention, corresponding to the portion of FIG. 3, which differs primarily in that a number of smaller coil springs 149' are substituted for the larger concentric coil spring 150. This second preferred embodiment includes the transfer arm 30, the guide structure 140, and the shaft 130 of the first preferred embodiment. However, this second preferred embodiment includes a somewhat modified flange 132' which is welded to the shaft 130. This modified flange 132' defines a plurality of openings 147' spaced around a circle centered on the shaft 130. Each of these openings 147' serves as a guide for a respective bolt 148', each of which is screwed into a respective threaded opening in a contact surface 146'. In each case, a coil spring 149' is mounted concentrically around the respective bolt 148' such that it bears at one end against the contact surface 146' and at the other end against the flange 132'. This second preferred embodiment functions identically to the first. However, since none of the coil springs 149' is concentric with the shaft 130, the coil springs 149' can readily be replaced as necessary without disassembling the shaft 130 from the guide structures 140,142. Thus, the structure of FIG. 4 is readily maintained and repaired in the field.

As previously mentioned, the clamps 120,122 are rigidly mounted to respective ends of the shaft 130. These two clamps are identical in structure, and will be described in detail in connection with FIG. 6, which is a cross-sectional view of clamp 122.

Before describing the clamps 120,122 in detail, it should be noted that these clamps are, with certain exceptions to be explained in detail below, identical to the clamps described in co-pending application Ser. No. 182,771, filed Aug. 29, 1980, assigned to the assignee of the present invention. That application is hereby incorporated by reference herein for its detailed description of this clamp.

Turning now to FIG. 6, clamp 122 includes two opposed clamping members 160,162 which are generally rectangular in cross-section and are mounted to slide freely within a clamping member guide structure which defines two mating rectangular cavities 170,172. The clamping members 160,162 are precisely guided by the guide cavities 170,172 such that clamping members 160,162 are restricted to movement along a straight line. The guide cavities 170,172 are formed between two parallel side plates. Only one of these side plates 174 is shown in FIG. 6; however, the second side plate (not shown) is parallel to and spaced from the side plate 174 such that the clamping members 160,162 move between the two side plates. Rocker arms 180,182 are mounted to the clamping members 160,162 about pivot points 184,186, respectively. Each of these rocker arms 180,182 is mounted to pivot about a respective pivot 188,190 supported by a cross-arm 192.

In addition, a hydraulic cylinder 194 is mounted between pivot points 196,198 on the ends of the rocker arms 180,182. Thus, as the hydraulic cylinder 194 varies the separation between the pivot points 196,198 on the rocker arms 180,182, the rocker arms 180,182 are caused to pivot about the pivot points 188,190, thereby causing the clamping members 160,162 to move along the straight line defined by the guide cavities 170,172.

A centering collar 200 is rotatably mounted on a pin 202 such that the centering collar 200 is free to rotate about an axis substantially parallel to the clamped tubular 230. A pair of link members 204,206 are mounted between the centering collar 200 and the rocker arms 180,182, respectively. As shown in FIG. 6, the link members 204,206 are attached to the centering collar 200 at two distinct attachment points 208,210, respectively. These attachment points 208,210 are selected such that, in the view shown in FIG. 6, the centering collar 200 is caused to rotate in a clockwise manner when the clamping members 160,162 are moved toward one another, and in a counterclockwise manner when the clamping members 160,162 are moved away from one another.

The attachment points 208,210 as well as the lengths of the link members 204,206 are chosen such that the centering collar 200 causes the two clamping members 160,162 to be symmetrically disposed with respect to the clamping axis 212. The clamping axis 212 can be thought of as a line passing through the axial center line of a clamped down hole tubular. In that the clamping members 160,162 are maintained in symmetrical positions with respect to the clamping axis 212, a clamped down hole tubular 230 is therefore consistently clamped in a predetermined position, regardless of the diameter of the clamped tubular 230.

The pin 202 is mounted in elongated slots (not shown) defined in the side plates 174. These elongated slots are oriented with their longest dimension pointing towards the clamping axis 212. These slots reserve to restrict the movement of the pin 202 in a direction parallel to the direction of movement of the clamping members 160,162 while allowing limited travel of the pin 202 towards and away from the clamping axis 212. This limited movement is provided to accommodate the slight change in separation between the cross-arm 192 and the clamping members 160,162 as the rocker arms 180,182 assume varying angular positions.

As shown in FIG. 6, each of the clamping members 160,162 includes a respective clamping surface 220,222. In this embodiment, each of the clamping surfaces 220,222 is formed of a wear resistant plastic material such as a high density polyurethane. Preferably, a granular abrasive, such as sand or carbide for example, is embedded in the plastic material to improve the gripping characteristics of the clamping surfaces. The clamping surfaces are mounted to the clamping members 160,162 by means of fasteners 224.

Because the clamping surfaces 220,222 are formed of a resilient plastic material, they are adapted to engage and grip the clamped tubular 230 frictionally without gouging the surface of the tubular 230 and without leaving deep clamping marks on the tubular 230. As shown in FIG. 1, the clamps 120,122 are used to grip the clamped tubular 230 at intermediate positions between the tool joints 232,234. Such intermediate portions generally have thinner walls which are more easily damaged by clamps than are the tool joints 232,234. The clamps 120,122 minimize gouging and other damage to the clamped tubular 230 by providing resilient clamping surfaces 220,222 which are adapted to engage the clamped tubular 230 frictionally without leaving deep scratches or gouges. Scratching or gouging can be a significant problem with transfer arms of the prior art, for tubulars are often not precisely straight. Also, the clamped tubular 230 is subjected to large accelerations as the transfer arm 30 is moved from the lowered position shown in FIG. 1 to the raised position shown in FIG. 1*a*. These conditions can cause ordinary clamps of the type having rigid, serrated clamping surfaces to leave undesirable scratches or gouges in the intermediate portions of the clamped tubular 230.

Referring now to FIG. 5, means are provided for rotating the shaft 130 and thereby the clamps 120,122 with respect to the transfer arm 30. This rotating means includes a plate 250 which is provided with an arc shaped cutout 252 as well as four key ways 254. The upper portion of the shaft 130 is provided with four mating keys 256 which are positioned to slide within the key ways 254 in the plate 250. The keys 256 and the key ways 254 cooperate to allow the shaft 130 to slide axially within the plate 250 while transmitting torque from the plate 250 to the shaft 130. The plate 250 is held in place against the guide structure 142 by means of a pin 258 which is positioned inside the arc shaped cutout 252 in the plate 250. Preferably, means (not shown) are provided for adjusting the position of the pin 258 in order to adjust the stop positions of the plate 250.

A hydraulic cylinder is positioned between an attachment point 262 in the plate 250 and the extreme end section of the transfer arm 30. This hydraulic cylinder 266 acts to rotate the plate 250 and thereby the shaft 130 through a 90° arc. The pin 252 acts as a stop which defines the two extreme rotational positions of the plate 250 and therefore the shaft 130. FIG. 5 shows the pin 258 in a first position and the hydraulic cylinder 266 attached to the first attachment point 262. When so configured, the hydraulic cylinder 266 acts to rotate the plate 250 in a counterclockwise direction through an arc of 90°. By merely moving the pin 258 from the position shown in FIG. 6 to the alternate position 260 and then removing the hydraulic cylinder 266 from the first attachment point 262 to the second attachment point 264, the hydraulic cylinder 266 can be made to rotate the plate 250 in a clockwise direction through an angular arc of 90°.

The hydraulic cylinder 266 is used to rotate the shaft 130 and therefore the clamps 120,122 to facilitate the loading and unloading of tubulars to and from the clamps 120,122. When the clamps 120,122 are rotated such that the line between the pin 202 and the clamping axis 212 is substantially horizontal, the clamps 120,122 are facing to the side, and tubulars can readily be rolled into or out of the clamps 120,122. By means of the alternate attachment points 262,264, the cylinder 266 can readily be configured to rotate the clamps 120,122 to whichever side of the transfer arm is more convenient. Conversely, when the hydraulic cylinder 266 is used to rotate the clamps 120,122 to the position shown in FIGS. 1 and 1*a*, the clamped tubular 230 is positioned in line with the axis of the string 42 when the transfer arm 30 is in the raised position shown in FIG. 1*a*.

The hydraulic tongs 60,70 are each self-centering clamps substantially identical in structure to the clamp of FIG. 6. The single difference between the tongs 60,70 and the clamp of FIG. 6 is that each of the tongs 60,70 is provided with a conventional, rigid, hard clamping surface instead of the resilient clamping surfaces 220,222 shown in FIG. 6. These rigid clamping surfaces, which bear only on the tool joints of the respective tubulars, are adapted to provide a firm grip which substantially prevents a clamped tubular from rotating in the tongs 60,70.

It should be understood that the present invention is not limited to the particular type of self-centering clamp shown in FIG. 6. To the contrary other types of self-centering clamps, such as those shown and described in co-pending patent applications Ser. No. 074,574, filed Sept. 11, 1979, and Ser. No. 182,770, filed Aug. 29, 1980, both assigned to the assignee of the present invention, provide a self-centering action by means of other structures.

Having described the structure of the preferred embodiments of the drawings, the operation of this structure can now be described by tracing the steps needed to add and remove a length of down hole tubular to a string. The first step in adding a length is to position the transfer arm 30 in the lower, substantially horizontal position shown in FIG. 1 and to rotate the clamps 120,122 to the side position. A length of down hole tubular 230 is then placed in the clamps 120,122 and the clamps are closed, to grip the clamped tubular 230 securely. This clamped tubular 230 defines tool joints 232,234 at opposite ends thereof, and the lower tool joint 232 includes a threaded end 236. The transfer arm 30 is then pivoted about the pivot 34 to the raised, substantially vertical position shown in FIG. 1*a*. At this point, the hydraulic cylinder 266 is used to rotate the clamps 120, 122 to the position shown in FIG. 1*a*. In this rotated position the clamped tubular 230 is aligned with the axis of the string 42.

Once the clamped tubular 230 is in the rotated position, the power swivel 50 is then lowered onto the upper tool joint 234 of the clamped tubular 230. As the power swivel 50 is lowered, the rotatable member 52 of the power swivel 50 is rotated to engage the threads of the rotatable member 52 with the threads of the upper tool joint 234. During this operation, the coil spring 150 acts to support the clamped tubular 230 resiliently such that the clamped tubular 230 is free to move downward under the axial forces applied to the tubular 230 by the power swivel 50. In this way, strain on the threads of the upper tool joint 234 is maintained at an acceptable level while the threaded connection is being made up.

In addition, the degree of compression of the spring 150 as well as the axial position of the clamped tubular 230 provide a visual indication to the operator of the drill rig as to the magnitude of the axial forces which are being applied by the power swivel 50 to the clamped tubular 230. This visual indication assists the operator in controlling the power swivel 50 so as not to exert undue axial forces on the clamped tubular 230. Because the clamped tubular 230 is free to move axially under applied forces, the precise position of the power swivel 50 is less critical.

The combination of axial movement of the clamped tubular 230 as well as resilient biasing of the position of the clamped tubular 230 provides important protection to the clamped tubular, thereby making tubular handling operations less sensitive to operator error and consequently reducing operator damage to clamped tubulars. In addition, the resilient clamping surfaces 220,222 of the clamps 120,122 reduce the incidence of clamping marks on the intermediate section of the clamped tubular 230 and thereby increase the useful working life of these tubulars.

Once the upper tool joint 234 has been mated with the power swivel 50, the clamps 120,122 are opened and the transfer arm 30 is lowered, leaving the tubular 230 suspended from the power swivel 50. The power swivel 50 is then lowered to bring the tubular 230 into contact with the uppermost length of tubular included in the string 42. The tongs 60,70 are positioned by means of the cylinder 82 such that the upper tong 60 is positioned adjacent the lower tool joint 232 of the tubular 230, and the lower tong 70 is positioned adjacent the uppermost tool joint of the string 42. The upper tong 60 can be closed partially about the tubular 230 to center the lower end of the tubular 230 about the clamping axis, so as to properly to align the tubular 230 for mating with the string 42. The rotatable member 52 of the power swivel 50 is then rotated so as to engage the threaded end 236 of the tubular 230 with the uppermost position of the string 42. The power swivel 50 is, however, not used to complete the mating of the tubular 230 with the string 42.

Rather, the tongs 60,70 are closed and then the hydraulic cylinder 100 is used to rotate the upper tong 60 as to tighten the threaded connection between the tubular 230 and the string 42. Standard pressure regulators are preferably used to control the hydraulic pressure used to drive the hydraulic cylinder 100, and thereby precisely to control the make up torque. Once the tubular 230 is secured to the string 42, the slips 40 and the tongs 60,70 are loosened; the power swivel 50 is then used to support and rotate the tubular 230, which is now an integral part of the string 42.

When a length of down hole tubular is to be removed from a drill string, the above described operations are substantially reversed. First the power swivel 50 is used to raise the string 42 such that the uppermost tubular is raised above the carrier 10. The slips 40 are then used to support the weight of the drill string 42, and the tongs 60,70 are positioned such that the upper tong 60 bears on the lower tool joint of the uppermost tubular of the string 42. The tongs 60,70 are then used to break the threaded connection between the uppermost tubular and the string, and then the swivel 50 is used to rotate the uppermost tubular and thereby to separate it from the string. The transfer arm 30 is positioned to the vertical position and the clamps 120,122 are clamped on the uppermost tubular suspended from the swivel 50. The swivel is then rotated to break the threaded connection between the uppermost tubular and the swivel 50. During this operation the upper spring 152 resists the upward movement of the clamped tubular under the axial load applied by the swivel 50. As before, the coil spring 152 acts to allow limited axial motion and to provide a visual indication of the axial loads being applied to the clamped tubular. In this way, excessive forces on the threads of the upper tool joint 234 are reduced during tubular handling operations. Once the clamped tubular has been separated from the swivel 50, the transfer arm 30 is then lowered to bring the clamped tubular to the position shown in FIG. 1.

The tongs 60,70 provide a number of important advantages. Because each of the tongs 60,70 utilizes a self-centering clamp such as the one shown in FIG. 6, manual adjustment of the tongs is not required when varying size tubulars are used. The combination of the transfer arm 30 and the tongs 60,70 results in a highly automated drill rig which to a great extent eliminates the need for operators to remain in dangerous positions near the moving tubular as it is installed in and removed from the drill string. This is an important safety consideration which also reduces the number of personnel required to operate the drill rig, and thereby the drilling costs.

From the foregoing, it should be apparent that an improved drill rig has been described which markedly reduces clamp damage and thread damage to clamped tubulars during tubular handling operations. In addition, this invention provides self-centering tongs which supply the torque necessary for reproduceable and effective make up and break out of threaded connections in a drill string, and which can be used to center and properly align lengths of tubulars.

Of course, it should be understood that the embodiments illustrated in the drawings and discussed above are illustrative examples set forth to describe preferred embodiments of the invention in detail. Various changes and modifications to the preferred embodiments described above can be made without departing from the spirit and scope of the present invention, which is defined by the following claims, including all equivalents.

I claim:

1. In combination with a drilling apparatus comprising a mast and a transfer arm positioned adjacent the mast to move down hole tubulars between a lowered position near ground level and a raised position aligned with the mast, the improvement comprising:

at least one clamp adapted to grip a down hole tubular having at least one threaded end;

means for mounting the clamp to the transfer arm such that the clamp is movable along an axis which is substantially parallel to the longitudinal axis of a tubular clamped in the at least one clamp; and means for resiliently biasing the clamp to a rest position with respect to the transfer arm;

said mounting means and biasing means cooperating to permit movement of the clamp under axial loads applied to a clamped down hole tubular during tubular handling operations, thereby reducing wear and damage to the threaded end of the clamped tubular.

2. In combination with a drilling apparatus comprising a mast and a transfer arm positioned adjacent the mast to move down hole tubulars between a lowered position near ground level and a raised position aligned with the mast, the improvement comprising:

a pair of clamps adapted to grip down hole tubulars having threaded ends;

means for mounting the clamps to the transfer arm such that the clamps are aligned on a common clamping axis and the clamps are movable in a direction parallel to the clamping axis; and means for resiliently biasing the clamps to a rest position on the clamping axis;

said mounting means and biasing means cooperating to permit a clamped down hole tubular to move resiliently along the clamping axis under applied loads, thereby reducing wear and damage to the threaded end of the clamped tubular.

3. The invention of claim 2 wherein each of the clamps is provided with at least one clamping member positioned to contact a clamped tubular, and further, wherein said at least one clamping member comprises:

a resilient clamping surface secured to the clamping member to contact the clamped tubular, said clamping surface acting to engage the clamped tubular frictionally, substantially without gouging the surface of the tubular.

4. The invention of claim 3 wherein the clamping surface comprises a plastic material.

5. The invention of claim 4 wherein the clamping surface further comprises a granular abrasive material embedded in the plastic material.

6. The invention of claim 2 wherein the mounting means comprises:

a shaft;

means for slideably mounting the shaft to the transfer arm such that the shaft is movable with respect to the transfer arm along a direction parallel to the clamping axis; and means for mounting the clamps to the shaft.

7. The invention of claim 6 wherein the biasing means comprises at least one coil spring positioned to bias the shaft to a predetermined position with respect to the transfer arm.

8. The invention of claim 6 further comprising:

means for rotating the shaft to move the clamps between at least two selected rotational positions.

9. In combination with a drilling apparatus comprising a substantially vertical mast and a transfer arm pivotably mounted adjacent the mast to transfer down hole tubulars between a lower, substantially horizontal position near ground level and an upper, substantially vertical position aligned with the mast, the improvement comprising:

a support structure slideably mounted to the transfer arm such that the support structure is slideably vertically when the transfer arm is in the upper position;

a pair of clamps adapted to clamp down hole tubulars;

means for mounting the pair of clamps to the support structure such that the clamps are aligned to clamp a tubular; and means for resiliently biasing the support structure to a rest position with respect to the transfer arm;

said clamps, support structure and biasing means cooperating to allow a clamped down hole tubular to move axially under applied loads, thereby reducing wear and damage to the clamped tubular during handling operations.

10. The invention of claim 9 wherein each of the clamps is provided wih at least one clamping member positioned to contact a clamped tubular, and further, wherein said at least one clamping member comprises:

a resilient clamping surface secured to the clamping member to contact the clamped tubular, said clamping surface acting to engage the clamped tubular frictionally, substantially without gouging the surface of the tubular.

11. The invention of claim 10 wherein the clamping surface comprises a plastic material.

12. The invention of claim 11 wherein the clamping surface further comprises a granular abrasive material embedded in the plastic material.

13. The invention of claim 9 wherein the support structure comprises a shaft.

14. The invention of claim 13 further comprising:

means for rotating the shaft to move the clamps between at least two selected rotational positions.

15. In combination with a drilling apparatus comprising a mast, a swivel mounted to move vertically in the mast, said swivel comprising a rotatable threaded member, and a transfer arm positioned adjacent the mast to move down hole tubulars between a horizontal position near ground level and a vertical position aligned with the mast, said tubulars each including a threaded end adapted to mate with the threaded end of the swivel, the improvement comprising:

a pair of clamps, each adapted to grip a down hole tubular;

means for slideably mounting the pair of clamps to the transfer arm such that both clamps are positioned to clamp a down hole tubular and a clamped tubular is free to move vertically with respect to the transfer arm when the transfer arm is in the vertical position; and means for resiliently biasing the pair of pipe clamps to a rest position;

said mounting and biasing means cooperating to permit a clamped tubular to move vertically with respect to the transfer arm and the swivel when the threaded member of the swivel is mated with and separated from the threaded end of the clamped tubular, thereby reducing wear and damage to the threaded end of the clamped tubular.

16. The invention of claim 15 wherein each of the clamps comprises at least two opposed clamping surfaces, wherein each of the clamping surfaces is formed of a resilient material.

17. The invention of claim 16 wherein the resilient material comprises a plastic material.

18. The invention of claim 17 wherein the plastic material is impregnated with an abrasive material.

19. The invention of claim 17 or 18 wherein the plastic material comprises a high density, wear resistant polyurethane.

20. The invention of claim 16 wherein the biasing means comprises a plurality of coil springs positioned to spring bias the movement of the clamps with respect to the transfer arm.

21. The invention of claim 15 wherein the mounting means comprises:

a shaft;

means for slideably mounting the shaft to the transfer arm; and means for mounting the clamps to the shaft.

22. The invention of claim 21 wherein the biasing means comprises at least one spring positioned to spring bias the movement of the shaft with respect to the transfer arm.

23. In combination with a drilling apparatus comprising a mast, a transfer arm positioned adjacent the mast to move down hole tubulars between a lowered position near ground level and a raised position aligned with the mast, and at least one clamp mounted on the transfer arm to clamp down hole tubulars, the improvement comprising:

at least two opposed clamping members included in the clamp, each of said clamping members comprising a resilient clamping surface fastened to the respective clamping member and disposed to engage a clamped down hole tubular frictionally, substantially without gouging the surface of the clamped tubular, such that the clamping member and clamping surfaces securely clamp the down hole tubular as it is moved between the raised and lowered position.

24. The invention of claim 23 wherein each resilient clamping surface comprises a plastic material.

25. The invention of claim 24 wherein each clamping surface further comprises a granular abrasive material embedded in the plastic material.

26. The invention of claim 24 wherein the plastic material comprises a high density, wear resistant polyurethane.

27. In combination with a drilling apparatus comprising means for supporting a string of down hole tubulars on a string axis, said string including a first length of down hole tubular and a second length of down hole tubular threadedly coupled to the first length, the improvement comprising:

first self centering tong means, mounted on the drilling apparatus in alignment with the supporting means, for clamping the first length of down hole tubular against rotation, said first tong means operative to clamp the first length about a first clamping axis, aligned with the string axis, for a range of diameters of the first length without manual adjustment of the first tong means;

second self centering tong means for clamping the second length of down hole tubular against rotation, said second tong means operative to clamp the second length about a second clamping axis for a range of diameters of the second length without manual adjustment of the second tong means;

means for mounting the second tong means to the drilling apparatus such that the second clamping axis is aligned with the string axis; and means for rotating the second tong means about the second clamping axis selectively to tighten and loosen the threaded connection between the first and second lengths.

28. The invention of claim 27 further comprising:

means for selectively positioning the first and second tong means at a selected one of a plurality of positions along the string axis.

29. The invention of claim 27 further comprising:

means for moving the first and second tong means between a first position, in which the first and second tong means are aligned with the string axis, and a second position, in which the first and second tong means are displaced laterally with respect to the string axis.

30. In combination with a drilling apparatus comprising means for supporting a string of down hole tubulars on a string axis, said string including a first length of down hole tubular and a second length of down hole tubular threadedly coupled to the first length, the improvement comprising:

first self centering tong means, mounted on the drilling apparatus in alignment with the supporting means, for clamping the first length of down hole tubular against rotation, said first tong means operative to clamp the first length about a first clamping axis, aligned with the string axis, for a range of diameters of the first length without manual adjustment of the first tong means;

second self centering tong means for clamping the second length of down hole tubular against rotation, said second tong means operative to clamp the second length about a second clamping axis for a range of diameters of the second length without manual adjustment of the second tong means;

means for mounting the first tong means on the drilling apparatus such that the first clamping axis is aligned with the string axis;

means for mounting the second tong means on the first tong means such that the second clamping axis is aligned with the string axis and the movement of the second tong means is restricted to rotation about the string axis; and means for rotating the second tong means about the second clamping axis selectively to tighten and loosen the threaded connection between the first and second lengths.

31. The invention of claim 30 wherein the means for mounting the second tong means comprises an arcuate guide affixed to one of the first and second tong means and an arcuate track affixed to the other of the first and second tong means and positioned such that the guide interlocks with the track to limit the movement of the second tong means with respect to the first tong means to rotation about the string axis.

* * * * *

UNITED STATES PATENT AND TRADEMARK OFFICE

CERTIFICATE OF CORRECTION

PATENT NO. : 4,403,666

DATED : September 13, 1983

INVENTOR(S) : Clyde A. Willis

It is certified that error appears in the above-identified patent and that said Letters Patent is hereby corrected as shown below:

IN THE DRAWINGS

Please include the following figure 1:

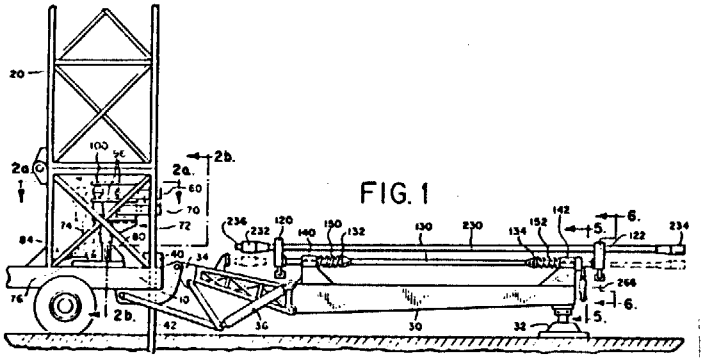

FIG. 1

UNITED STATES PATENT AND TRADEMARK OFFICE

CERTIFICATE OF CORRECTION

PATENT NO. : 4,403,666

DATED : September 13, 1983

INVENTOR(S) : Clyde A. Willis

It is certified that error appears in the above-identified patent and that said Letters Patent is hereby corrected as shown below:

IN THE DRAWINGS

Please include the following figure 5:

FIG. 5

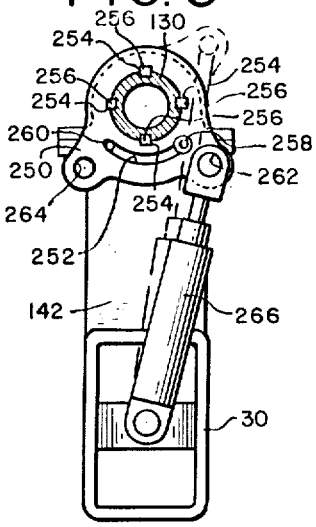

UNITED STATES PATENT AND TRADEMARK OFFICE

CERTIFICATE OF CORRECTION

PATENT NO. : 4,403,666

DATED : September 13, 1983

INVENTOR(S) : Clyde A. Willis

It is certified that error appears in the above-identified patent and that said Letters Patent is hereby corrected as shown below:

IN THE DRAWINGS

Please include the following figure 6:

FIG. 6

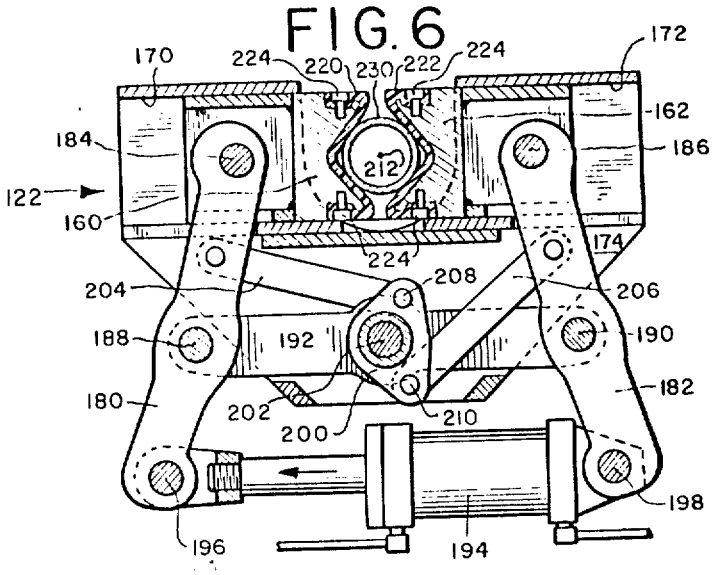

UNITED STATES PATENT AND TRADEMARK OFFICE

CERTIFICATE OF CORRECTION

PATENT NO. : 4,403,666

DATED : September 13, 1983

INVENTOR(S) : Clyde A. Willis

It is certified that error appears in the above-identified patent and that said Letters Patent is hereby corrected as shown below:

IN THE SPECIFICATION

At column 8, line 60, delete "Ser. No. 074,574," and substitue therefore -- Ser. No. 074,547, --;

At column 10, line 4, after "60" insert -- so --.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*